US005676400A

United States Patent [19]

Lin

[11] Patent Number: 5,676,400

[45] Date of Patent: Oct. 14, 1997

[54] MARKING BOARD FOR ATTACHMENT TO GOLF TROLLEY

[75] Inventor: Liz Lin, San Diego, Calif.

[73] Assignee: Super-Tec Manufacturing, San Diego, Calif.

[21] Appl. No.: 709,760

[22] Filed: Sep. 9, 1996

[51] Int. Cl.[6] ..... B42D 3/00

[52] U.S. Cl. ..... 281/45; 281/51

[58] Field of Search ..... 281/21.1, 43, 45, 281/51; 224/918, 919, 274; 280/DIG. 5; 248/444.1, 444, 447.2

[56] References Cited

U.S. PATENT DOCUMENTS

| | | | |
|---|---|---|---|
| 3,128,021 | 4/1964 | Habbena | 224/274 |
| 3,156,000 | 11/1964 | Westhoff | 224/274 |
| 4,361,934 | 12/1982 | Dapwell | 281/45 |
| 5,387,010 | 2/1995 | Mohr | 281/45 X |
| 5,435,474 | 7/1995 | Lin | 224/274 |
| 5,489,121 | 2/1996 | Mohr | 281/45 X |

*Primary Examiner*—Willmon Fridie, Jr.

*Attorney, Agent, or Firm*—Morton J. Rosenberg; David I. Klein

[57] ABSTRACT

A marking board for attachment to golf trolley comprising a plate with a hollow for holding papers therein, clipping elements for clipping and locating papers thereon and hollow tubes and pipes on the underside of the plate for holding tees, golf bail position marking pegs and pens. The plate is further provided with curved recesses on two opposing sides thereof to facilitate the withdrawal of the papers from the hollow. A ball holder is connected to one perimeter edge of the plate and comprises a flat portion and a curved portion to receive golf balls within a room between the portions, protrusions being provided on two sides of the curved portions to prevented the balls from sideward falling off the room.

2 Claims, 7 Drawing Sheets

MARKING BOARD FOR ATTACHMENT TO GOLF TROLLEY

BACKGROUND OF THE INVENTION

A heretofore known marking board for attachment to golf trolley was developed for use, which board is fixed to a golf trolley and has mark keeping papers 2 (see FIG. 9) held thereon for golf player to put down their marks.

Referring to FIG. 9, the marking board, generally numbered 1, has a fixing hole 19, two through holes 11 on an upper part thereof, a recess 20 between the holes 11, two ball sockets 16 on the side opposite the upper part; the fixing hole 19 is engaged with a screw (not shown) which is then passed into the shaft of the golf trolley such that the board 1 is fastened to the golf trolley; the holes 11 and the recess 20 are associated with a locating element 3. The locating element 3 has a pair of combining plates 32 retained within the recess 20 of the board 1 and two inserting pins 31 which is arranged such that they 31 can pass through locating holes 21 of the papers 2 and the through holes 11 of the board 1 to locate the papers 2 on the board 1. Furthermore, the locating element 3 has several holding elements 33 for holding the golf ball position marking pegs (not shown). There are provided tee holding holes 18 on one side of the board 1 for tees (not shown) to be passed thereinto and thus stored on the board 1. On the side opposite the holes 18, a hole 15, a trench 14 and a clipping part 12 are provided for holding pens; a pen can be inserted into the hole 15 perpendicular to the board 1, or disposed between the board 1 and the clipping part 12, or placed on the trench 14 depending on need. Each ball socket 16 is provided with an anti-fall element 17 to hold on to the golf ball (not shown) inserted into the socket 16.

This paper holding board is found to have following disadvantages.

1. The anti-fall elements 17 and the clipping parts 12 are made to be thin in order to be flexible, resulting in fragility thereof.
2. The papers have to be specifically bored and cut in order to match with the board, resulting in high manufacturing cost of the papers used.
3. The fixing hole 19 and the screw engaging the fixing hole 19 are likely to form an uneven surface on the board, causing inconvenience in writing with the board.
4. The paper is likely to be broken from the middle if the user fails to be careful in tearing it off the board.
5. Being not protected by any cover, the papers placed on the board are likely to become useless because of rain or water.

SUMMARY OF THE INVENTION

The marking board of the present invention comprises a paper holding plate and a ball holder; the plate has a hollow for storing papers therein. The plate is further provided with curved recesses on two perimeters thereof such that the stored papers can be reached and taken out of the hollow by hands. Two clipping elements are anchored to the upper side of the plate to locate papers placed on the upper side of the plate. Hollow tubes and a hollow pipe are affixed to the underside of the plate such that tees or ball position marking pegs can be deposited inside the tubes and pens can be inserted into the pipe.

The ball holder consists of a flat portion and a curved portion; the flat portion is connected to the curved portion and to the plate with a height difference between the flat portion and the plate.

The curved portion is arranged such that golf balls can be inserted into the room formed between the flat portion and the curved portion; protrusions are provided on two lateral sides of the curved portions in order to prevent the balls from sidewards falling off the ball holder; the plate has a corner, which is just above the joint of the flate portion and the plate, to prevent the inserted balls from upwardly falling off the ball holder.

BRIEF DESCRIPTION OF DRAWINGS

The invention will be better understood by reference to the accompanying drawings, wherein.

DESCRIPTION OF THE PREFERRED EMBODIMENTS

Figure 1:
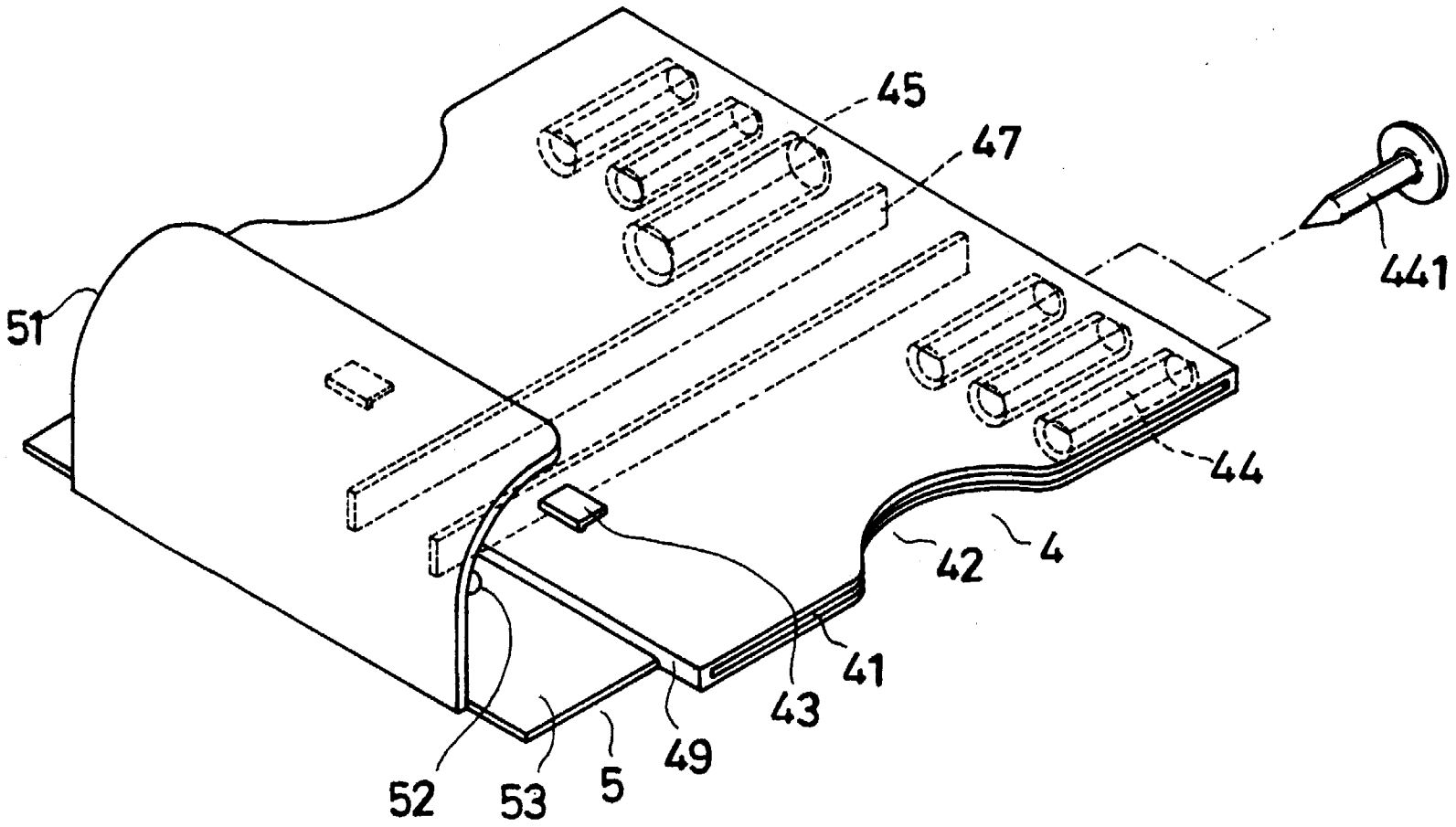
FIG. 1 is a view of the marking board of the present invention.
Figure 3:
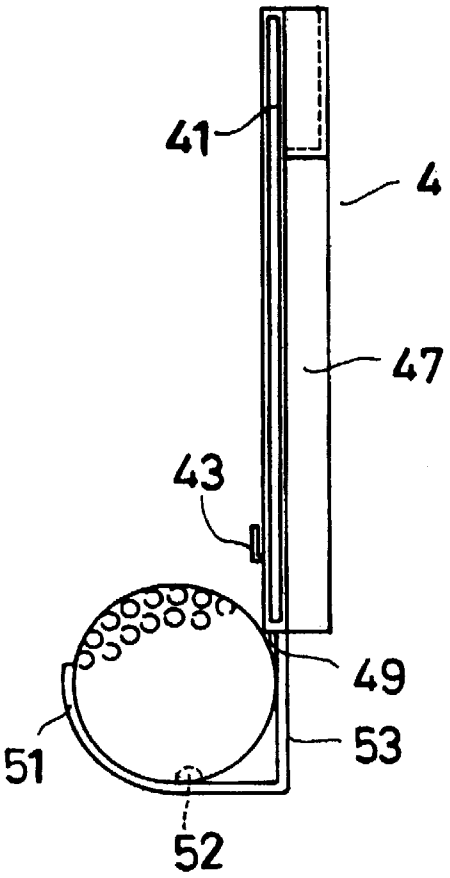
FIG. 3 is a side elevation of the marking board of the present invention.
Figure 2:
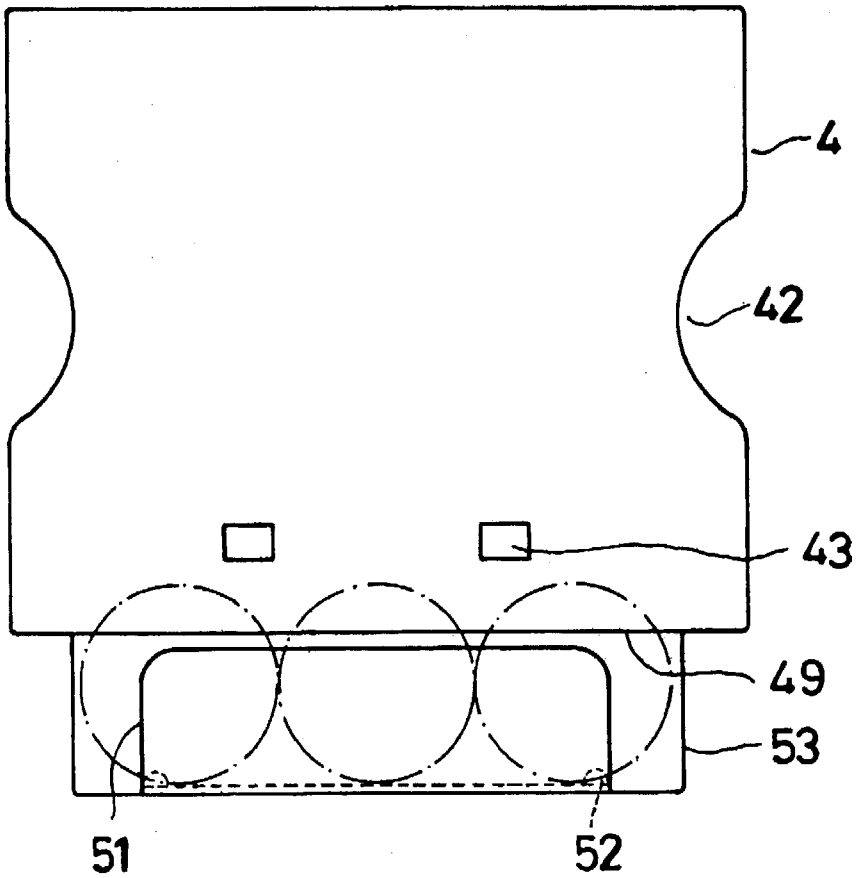
FIG. 2 is a front elevation of the marking board of the present invention.

A marking board of the present invention, referring to FIG. 1, comprises a paper holding plate 4 and a ball holder 5 as the main parts; the plate 4 has a hollow 41 defined by an upper plate portion 411 and a low plate portion 412 for storing papers therein. The plate 4 further is provided with curved recesses 42 on two opposing perimeters thereof such that the papers stored in the hollow 41 can be reached and taken out of the hollow 41 by hands. Two clipping elements 43 are anchored to the upper plate portion 411 of the plate 4 (see FIG. 1 and FIG. 3) such that papers can be located on the upper plate portion 411 by means of inserting one perimeter edge of the papers into apertures between the clipping elements 43 and the upper plate portion 411.

A plurality of hollow tubes 44 and a hollow pipe 45 are affixed to the lower plate portion 412 such that tees (not shown) or ball position marking pegs 441 (see FIG. 1) can be deposited inside the tubes 44 and pens (not shown) can be inserted into the pipe 45.

Figure 5:
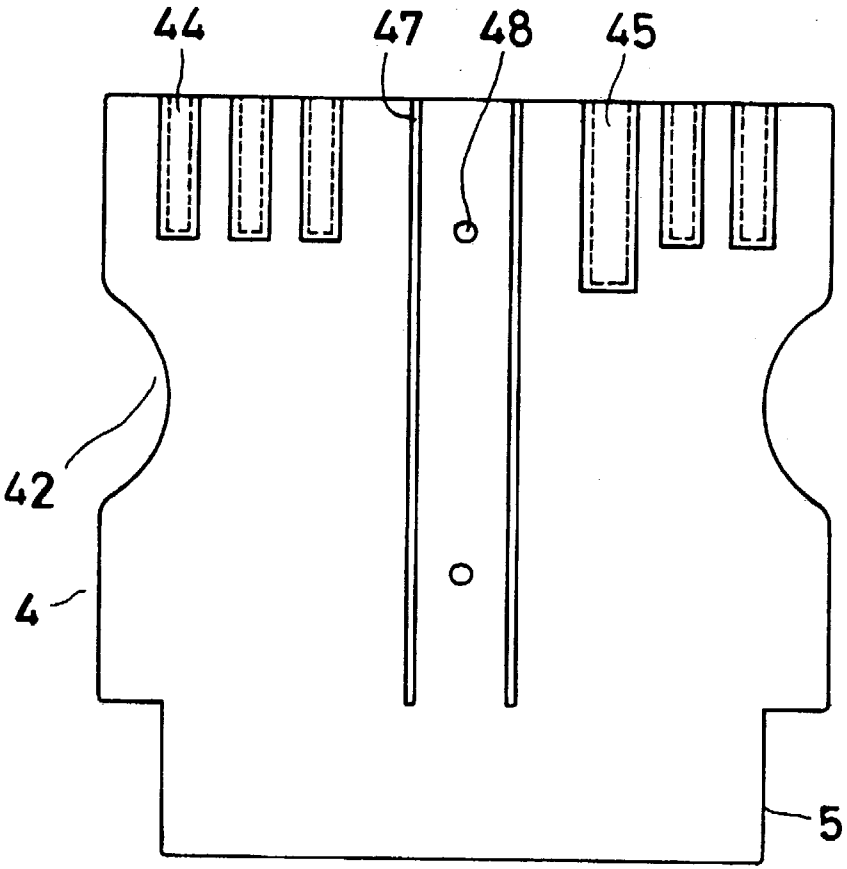
FIG. 5 is a rear elevation of the marking board of the present invention.
Figure 4:
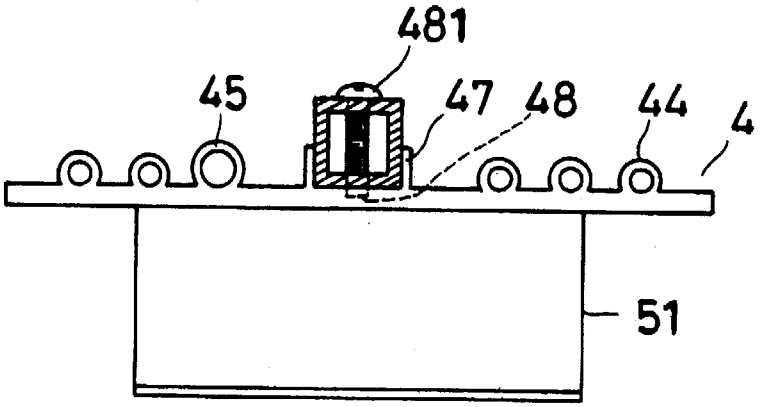
FIG. 4 is a bottom view of the marking board of the present invention.
Figure 6:
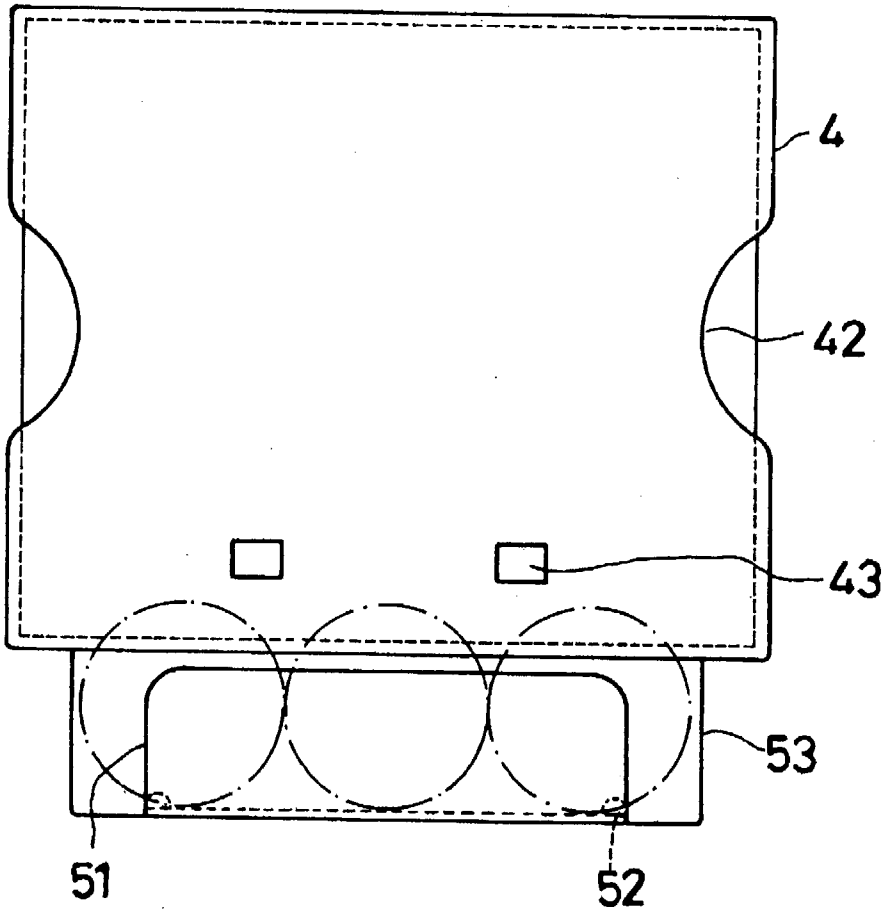
FIG. 6 is a view showing the marking board of the present invention with papers deposited in the hollow.
Figure 7:
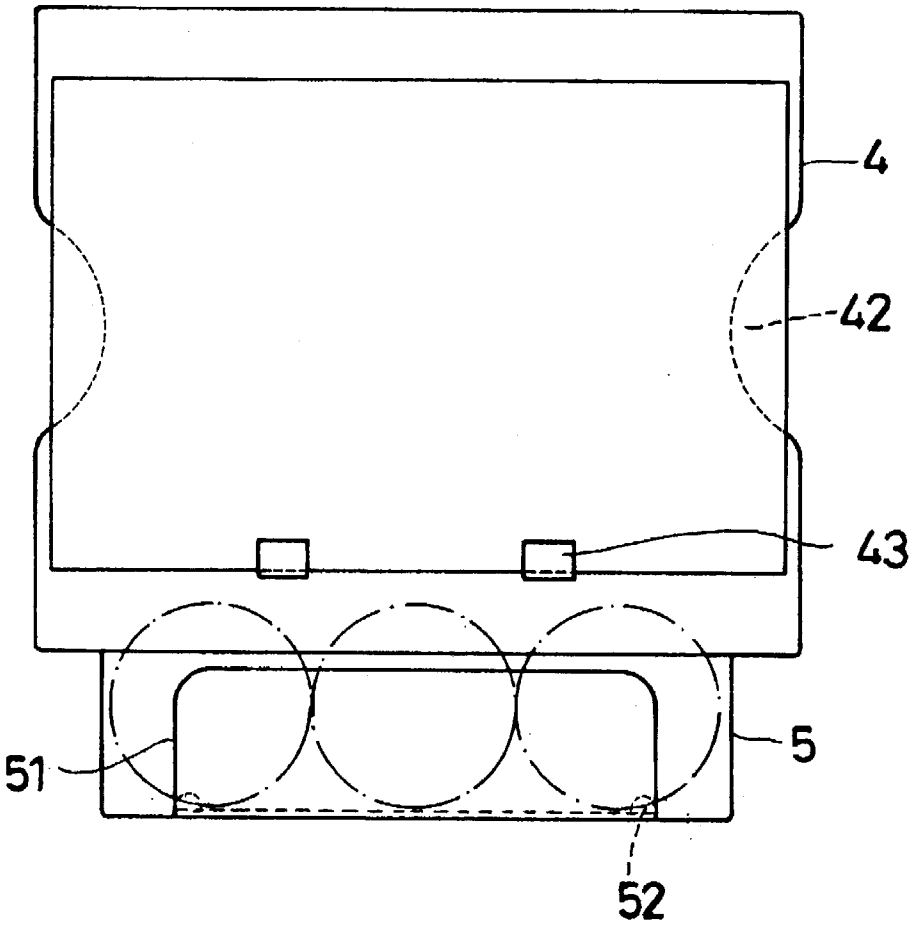
FIG. 7 is a view showing the marking board of the present invention with papers arranged on the board.
Figure 8:
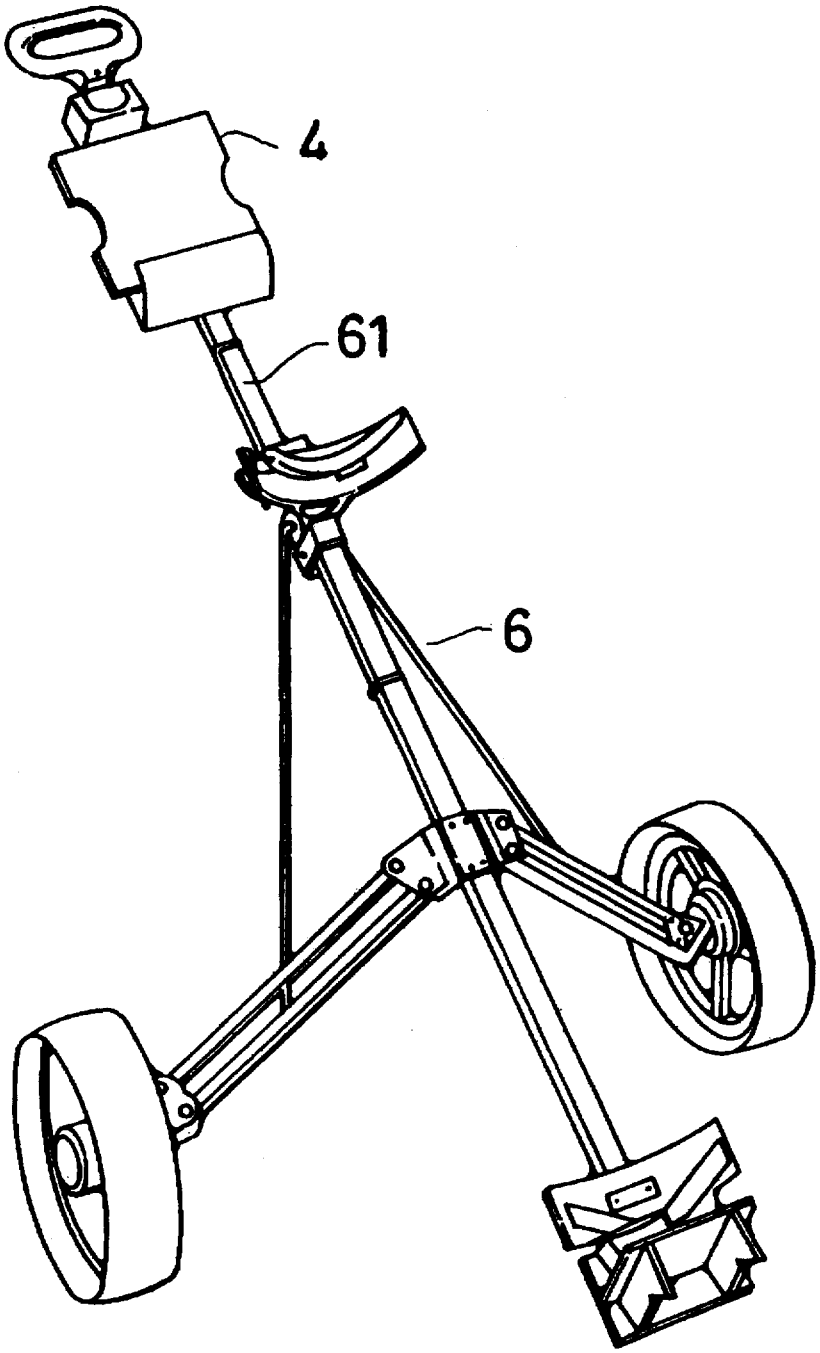
FIG. 8 is a view showing the marking board of the present invention when affixed to a golf trolley; and, FIG. 9 is an exploded view of a prior art marking board as described in the BACKGROUND.
Figure 9:
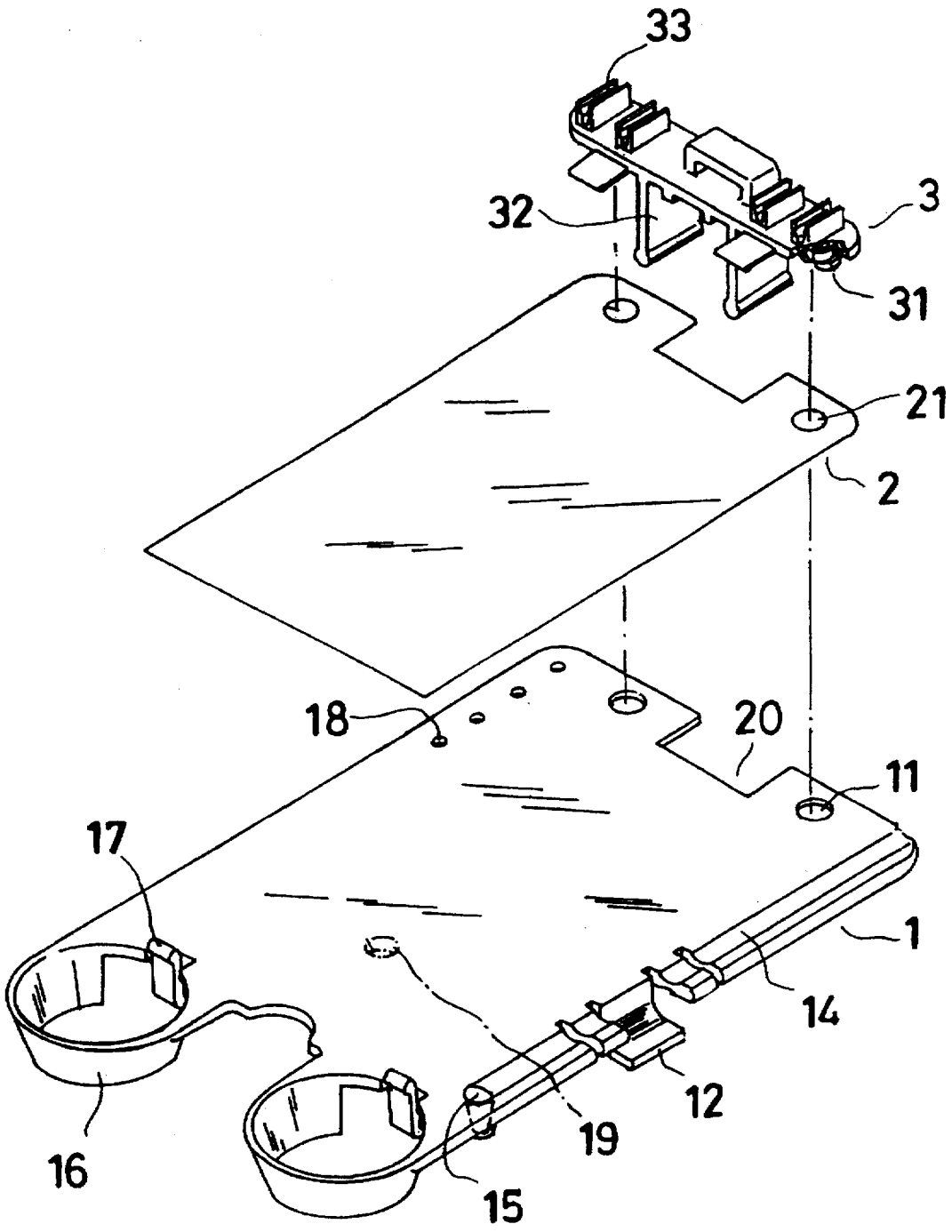
FIG. 9 (PRIOR ART)

A pair of fixing plates 47 are provided on the lower plate portion 412 and spaced such that a shaft 61 of a golf trolley 6 (see FIG. 8) can be firmly inserted therebetween. Furthermore, the lower plate portion 412 has threaded holes 48 (see FIG. 5) provided thereon to engage screws 481 (see FIG. 4) passed through the shaft 61 in order for the board of the present invention to be fixed to the golf trolley 6.

The ball holder 5 consists of a flat portion 53 and a curved portion 51; the flat portion 53 is connected to the curved portion 51 on one perimeter edge and to the plate 4 on the opposite perimeter edge with a height difference (see FIG. 1) between the flat portion 51 and the upper plate portion 411.

The curved portion 51 is arranged such that golf balls (see FIG. 3) can be inserted into the room formed between the flat portion 53 and the curved portion 51; protrusions 52 are provided on two lateral sides of the curved portions in order to prevent the balls from sidewards falling off the ball holder 5; the plate 4 has a corner 49 (see FIG. 1), which is just above the joint of the flate portion 53 and the plate 4, to prevent the inserted balls from upwardly falling off the ball holder 5; the curved portion 51 is flexible such that the inserted balls can be easily taken out of the holder 5 upon pushing the portion 51 outwardly of the flat portion 53.

After the marking board is affixed to the golf trolley, papers are arranged on the board, located by the clipping elements 43 for recording points while playing golf. And,. ball position marking pegs 441 and golf balls are stored in their respective positions, i.e. the tubes 44 and the ball holders 5, and can be removed therefrom for use.

From the above description, the paper holding board of the present invention can be known to have following advantages.

1. The hollow 41 can prevent the papers deposited therein from getting wet in raining days.
2. The tubes 44 can prevent sharp ends of the tees or ball position marking pegs 41 from sticking out and hurting the users.
3. The papers can be easily removed from the board without getting broken due to the design of the clipping elements 43. And, the curved recesses 42 can facilitate the removing of the papers from the hollow 41.
4. The design of the ball holder 5 provides more room for golf balls than the prior art ball sockets, i.e. more golf balls can be stored by means of the ball holder when the board of the present invention is of the same size as the prior art paper holding board.

While the preferred embodiments of the invention have been described above, it will be recognized and understood that various modifications may be made therein and the appended claims are intended to cover all such modifications which may fail within the spirit and scope of the invention.

What is claimed is:

1. A marking board for attachment to golf trolley, comprising:

a paper holding plate having a hollow defined by a first plate portion and a second plate portion under said first plate portion; said paper holding plate being provided with two curved recesses on a first perimeter edge and a second perimeter edge opposing said first edge respectively; said hollow being provided for depositing papers therein;

a plurality of hollow tubes affixed to said second plate portion;

a plurality of hollow pipes affixed to said second plate portion;

a plurality of clipping elements anchored to said first plate portion; an aperture being formed between each clipping element and said first plate portion for locating papers inserted therein.

2. The writing board for attachment to golf trolley as recited in claim i further comprising a ball holder connected to one side of said paper holding plate; said ball holder consisting of a flat portion and a curved portion;

said flat portion being connected to said side of said paper holding plate and arranged at least lower than said first plate portion;

said curved portion being connected to said flat portion to form a room in between for holding golf balls and provided with protrusions on two sides thereof.

* * * * *